US010240612B2

(12) United States Patent
Yang et al.

(10) Patent No.: US 10,240,612 B2
(45) Date of Patent: Mar. 26, 2019

(54) CENTRIFUGAL COMPRESSOR WITH INLET DUCT HAVING SWIRL GENERATORS

(71) Applicant: Imperial Innovations Limited, London (GB)

(72) Inventors: Mingyang Yang, London (GB); Ricardo Martinez-Botas, Middlesex (GB)

(73) Assignee: Imperial Innovations Limited, London (GB)

( * ) Notice: Subject to any disclaimer, the term of this patent is extended or adjusted under 35 U.S.C. 154(b) by 631 days.

(21) Appl. No.: 14/890,007

(22) PCT Filed: May 9, 2014

(86) PCT No.: PCT/GB2014/051416

§ 371 (c)(1),
(2) Date: Nov. 9, 2015

(87) PCT Pub. No.: WO2014/181119

PCT Pub. Date: Nov. 13, 2014

(65) Prior Publication Data

US 2016/0131154 A1 May 12, 2016

(30) Foreign Application Priority Data

May 9, 2013 (GB) ..... 1308381.1

(51) Int. Cl.
*F04D 29/44* (2006.01)
*F04D 29/42* (2006.01)
(Continued)

(52) U.S. Cl.
CPC ..... *F04D 29/441* (2013.01); *F04D 17/10* (2013.01); *F04D 29/284* (2013.01);
(Continued)

(58) Field of Classification Search
CPC ..... F04D 29/441; F04D 29/4213
See application file for complete search history.

(56) References Cited

U.S. PATENT DOCUMENTS 2,405,282 A * 8/1946 Birmann ..... F04D 29/464 415/159
4,375,937 A * 3/1983 Cooper ..... F04D 15/00 415/143

(Continued)

FOREIGN PATENT DOCUMENTS

DE 10223876 A1 12/2003
EP 0331902 A2 9/1989

(Continued)

OTHER PUBLICATIONS

"International Search Report, issued in International Patent Applicaiton No. PCT/GB2014/051416 dated Aug. 4, 2014", , Publisher: ISA / EPO.

*Primary Examiner* — Woody A Lee, Jr.
(74) *Attorney, Agent, or Firm* — Kaplan Breyer Schwarz, LLP

(57) ABSTRACT

A centrifugal compressor is disclosed. The centrifugal compressor comprises an inlet and an impeller comprising a hub and blades. The inlet is for conveying flow to the impeller comprising guide means and is arranged to guide the flow through the inlet to induce swirl in the flow adjacent tips of the blades, the direction of swirl being the direction of rotation of the blades, without substantially disturbing flow adjacent the hub.

15 Claims, 6 Drawing Sheets

(51) Int. Cl.
*F04D 17/10* (2006.01)
*F04D 29/28* (2006.01)
*F04D 25/02* (2006.01)

(52) U.S. Cl.
CPC ..... *F04D 29/4213* (2013.01); *F04D 29/4233* (2013.01); *F04D 25/024* (2013.01); *F05D 2220/40* (2013.01); *F05D 2250/51* (2013.01)

(56) References Cited

U.S. PATENT DOCUMENTS

| | | | | |
|---|---|---|---|---|
| 4,743,161 | A * | 5/1988 | Fisher | F04D 29/4213 415/116 |
| 4,990,053 | A * | 2/1991 | Rohne | F04D 29/4213 415/143 |
| 5,277,541 | A * | 1/1994 | Palmer | F04D 29/4213 415/206 |
| 7,189,059 | B2 * | 3/2007 | Barton | F01D 5/26 415/186 |
| 9,726,185 | B2 * | 8/2017 | Chen | F04D 17/10 |
| 9,850,913 | B2 * | 12/2017 | An | F04D 29/441 |
| 2004/0009061 | A1 * | 1/2004 | McDonald | F02C 7/04 415/151 |
| 2005/0263199 | A1 * | 12/2005 | Meheen | F01D 9/06 138/44 |
| 2007/0224032 | A1 * | 9/2007 | Gu | F04D 29/4213 415/58.4 |
| 2015/0192147 | A1 * | 7/2015 | An | F04D 29/4213 415/58.4 |

FOREIGN PATENT DOCUMENTS

| | | |
|---|---|---|
| GB | 599735 | 6/1948 |
| JP | S5896197 A | 6/1983 |

* cited by examiner (a) without IDT (b) with IDT

CENTRIFUGAL COMPRESSOR WITH INLET DUCT HAVING SWIRL GENERATORS

CROSS REFERENCE TO RELATED APPLICATIONS

This application is a national phase of PCT application No. PCT/GB2014/051416, filed 9 May 2014, which claims priority to GB patent application No. 1308381.1, filed 9 May 2013, all of which are incorporated herein by reference.

FIELD

This invention relates to a guide means for guiding fluid flow. In particular, embodiments relate to a modified inlet duct for a centrifugal compressor in a turbocharger.

BACKGROUND

The use of a turbocharger in a vehicle engine increases the power output of the engine for a given engine size. Turbochargers therefore reduce fuel consumption for a particular desired power output by engine downsizing and are therefore an important technology in reducing emissions of gases contributing to climate change and environmental pollution. When turbocharged smaller engines are used to replace bigger engines, they provide a similar performance with greater fuel economy. There has therefore been an upsurge in interest in the use of turbochargers.

The usefulness of conventional turbocharger technology comprising a centrifugal compressor is, however, limited by the operating range of the centrifugal compressor. The operating range is determined by the operating points at which the compressor experiences surge and choke, with the operating range being between these two points of operation. The phenomenon of "surge" is characterised by a reversal in fluid flow through the compressor, and occurs when the compressor is unable to force fluid against the pressure gradient on either side of its blades and to continue compressing air. It typically occurs as the pressure ratio in the compressor increases. The phenomenon of "choke" is characterised by a maximum in flow rate through the compressor. It typically occurs as the pressure ratio in the compressor decreases.

The operating range of the compressor in a turbocharger can be a limiting factor on the performance of a turbocharged engine. The limited operating range of the compressor means that the turbocharger will not perform well across a wide range of operating conditions. One solution is to use two or more turbochargers in a vehicle, one or more of them being optimised for high load and low r.p.m. of the engine, and at least one other for low load and high r.p.m. This solution has the drawbacks, however, of adding extra cost, weight and complexity to a vehicle containing these additional turbochargers. The control of two or more turbochargers is also more complex than controlling a single turbocharger. Attempts have therefore been made to control the flow of air into the compressor to decrease the mass flow rate at which surge occurs and to increase the mass flow rate at which choke occurs.

Casing treatment is one such flow control method. A channel is introduced in the compressor casing to encourage recirculation of high-pressure fluid at the impeller inlet. Swirl vanes may also be introduced within this recirculation channel. This casing treatment can decrease the mass flow rate at which surge begins, but it increases the complexity and cost of a turbocharger and is ineffective at low speeds.

A second method of flow control intended to, in effect, increase the operating range of a turbocharger, by shifting that operating range during use, is the use of variable inlet guide vanes. The angle of these vanes determine the angle of air flow at the compressor's impeller inlet. The vane angle is adjusted based on one or more operating condition. A drawback of this approach is this requirement for active control of the vane angle. If the vane angle is not adjusted according to operating conditions, they can have a throttling effect on the compressor. When the vanes are set at an angle which decreases the maximum mass flow value at which compressor surge occurs, they have a throttle effect which reduces the minimum mass flow value at which choke occurs. The operating range of the turbocharger is therefore not extended by the use of variable inlet guide vanes, but merely shifted.

It is therefore desirable to address these disadvantages.

SUMMARY

According to an aspect of this invention, there is provided a centrifugal compressor comprising an inlet and an impeller comprising a hub and blades, the inlet for conveying flow to the impeller and comprising guide means arranged to guide the flow to induce swirl in the flow adjacent tips of the blades, the direction of swirl being the direction of rotation of the blades, without substantially disturbing flow adjacent the hub.

In at least certain embodiments, the fact that the guide means are arranged to guide flow to induce swirl adjacent tips of the blades reduces the maximum mass flow rate through the compressor at which surge occurs. The fact that flow adjacent to the hub is not substantially disturbed prevents the throttling effect which would result from flow being swirled adjacent to the hub and therefore does not significantly reduce the minimum mass flow rate at which choke occurs. This increases the stability of the compressor by widening the range of conditions under which it can operate without experiencing surge or choke.

The flow may be flow in the inlet. The flow may be flow adjacent to or at an exit of the inlet. The flow may be flow adjacent to or at the impeller.

Each tip may comprise the radially outer part of a blade of the blades may comprise the radially outer parts of the blades. They may comprise the radially outer edges of the blades.

The guide means may be arranged to guide a radially outer part of the flow so as to swirl that part without substantially disturbing the remainder of the flow. The guide means may be arranged to guide the flow so as not to disturb axial flow in a radially inner part. The guide means may be arranged to guide the flow without substantially disturbing substantially axial flow adjacent the hub.

The guide means may comprise structure that deflects the flow. The guide means may be arranged to guide the flow by providing at least one surface that is substantially oblique to the flow incident on the guide means.

In at least certain embodiments, the provision of a surface that is substantially oblique to the flow forces flow to travel in the direction in which the surface is angled. This encourages fluid swirl.

The at least one surface may be substantially oblique to the axis of the inlet. The at least one surface may at least partly be angled in the direction of rotation of the impeller.

In at least certain embodiments, the surface being substantially oblique to the axis of the inlet ensures that the surface is oblique to the axis of rotation of the impeller blades. Fluid passing deflected by the surface is therefore swirled towards the rotational direction of the impeller, but axial flow adjacent the impeller hub is not disturbed. The swirled flow improves the stability of the impeller by reducing the incidence angle of the flow onto the impeller blade tips. The fact that fluid flowing adjacent the impeller hub remains in an axial direction reduces throttling of the compressor compared to the case where flow is swirled across the width of the impeller.

Each of the at least one surfaces may be embodied by a passageway. There may be a plurality of passageways. Each passageway of the plurality of passageways may be oblique to the axis of the inlet. Each passageway may be substantially in a plane tangential to and parallel to the axis of the inlet. Each passageway may be substantially at the same angle to the axis in its respective plane as each other passageway. Each passageway may be formed in the structure of the inlet.

Each of the at least one passageways may be a hole. The hole may be substantially circular in cross section. There may be thirty holes. Each of the at least one passageways may be a channel, open to a radially inner part of the inlet.

The inlet may comprise a restriction of smaller inner diameter than the inner diameter of the remainder. The restriction may comprise a face substantially perpendicular to the axis of the inlet. Each of the at least one passageways may be located in the restriction. Each of the at least one passageways may extend along the restriction. When the passageways are holes, they may pass through the restriction. When there is a plurality of passageways, each passageway may be angularly distributed in the restriction around, and with respect to, the axis. The passageways may be evenly circumferentially distributed about the restriction. The circumferential distance between any two adjacent passageways may be substantially equal to the circumferential distance between any other two adjacent passageways.

In at least certain embodiments, by reducing the inner diameter of the inlet, some of the fluid passing through the inlet duct is forced through the at least one passageway. The face of the restriction that is substantially perpendicular to the axis encourages fluid to flow through the at least one passageway.

The restriction may be shaped to comprise a surface which slopes from the perpendicular face to the wall of the inlet.

In at least certain embodiments, the sloping surface of the restriction acts as a fairing to prevent separation of the fluid flow.

According to a second aspect of the invention, there is provided a turbocharger comprising a compressor as defined hereinabove.

Optional features of the first aspect are also optional features of the second aspect.

According to a third aspect of the invention, there is provided an inlet as defined hereinabove.

Optional features of the first and second aspects are also optional features of the third aspect.

According to a fourth aspect of the invention, there is provided guide means as defined hereinabove.

Optional features of the first, second and third aspects are also optional features of the fourth aspect.

BRIEF DESCRIPTION OF THE DRAWINGS

Specific embodiments will be described below by way of example only and with reference to the accompanying drawings, in which:

FIG. 5(*b*) shows the distribution of absolute flow angle near the inlet of the impeller in the compressor including the modified inlet duct;

FIG. 6(*b*) shows the relative Mach number distribution in a surface behind the impeller leading edges in the compressor including the modified inlet duct;

SPECIFIC DESCRIPTION OF CERTAIN EXAMPLE EMBODIMENTS

[Construction]

Figure 1:
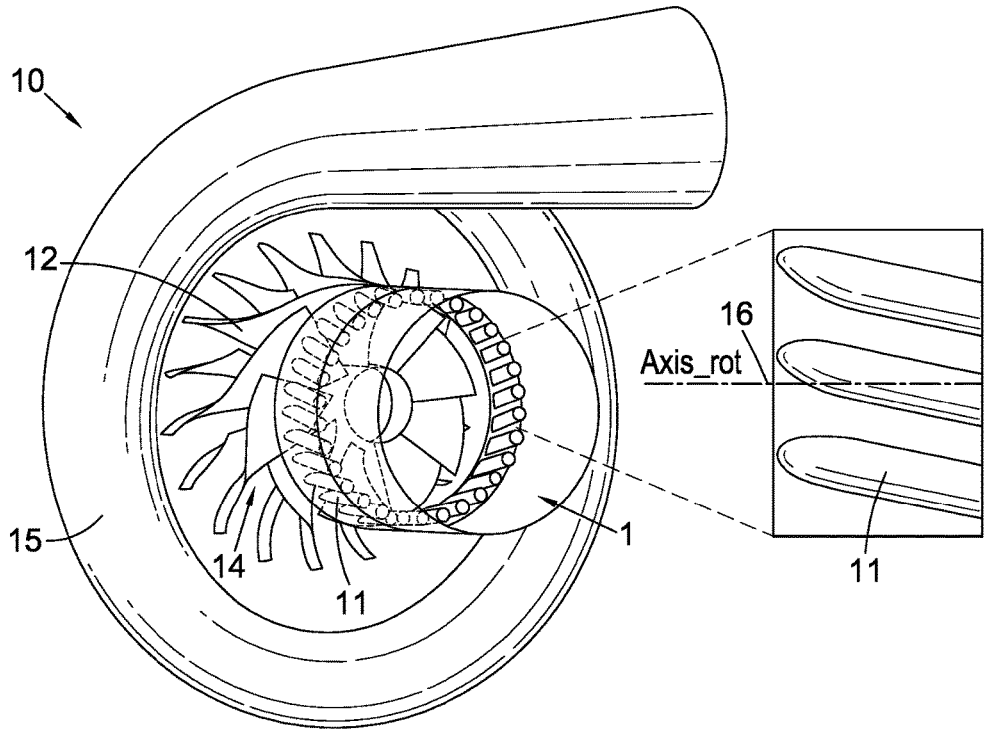
FIG. 1 is a schematic diagram of a centrifugal compressor including a modified inlet duct.

FIG. 1 shows a centrifugal compressor 10 including a guide means for guiding fluid flow. The guide means is in the form of a modified inlet duct 1. The compressor 10 forms part of a turbocharger (not shown) for a vehicle internal combustion engine (ICE). In this embodiment, the vehicle is a passenger car. In other embodiments, it could conceivably be any other form of automotive vehicle using an ICE, for example a bus, commercial vehicle or motorcycle. The compressor 10 also includes an impeller 14, having impeller blades 12 arranged around an impeller axis 16, the modified inlet duct 1, which guides air into the impeller 12, and a volute 15 to receive air that has passed through the impeller. In this embodiment, the compressor 10 has a pressure ratio of 4.0, a design speed (N) of 65000 rpm and a design mass flow of 1.3 kg/s. The radius of the exit to the impeller 14 is 75 mm. The Mach number of the impeller blades 12 at the end of their leading edge which is closest to the air inlet (i.e. their inlet tip) is 1.08. The sweep angle of the impeller blades 12 is −35 degrees. Finally, the blade number in this embodiment is 9+9; that is, there is one set of nine blades 12 arranged around the axis, and a second set of nine blades 12 interposed between these but axially off-set. These components are similar to existing ones.

Figure 2:
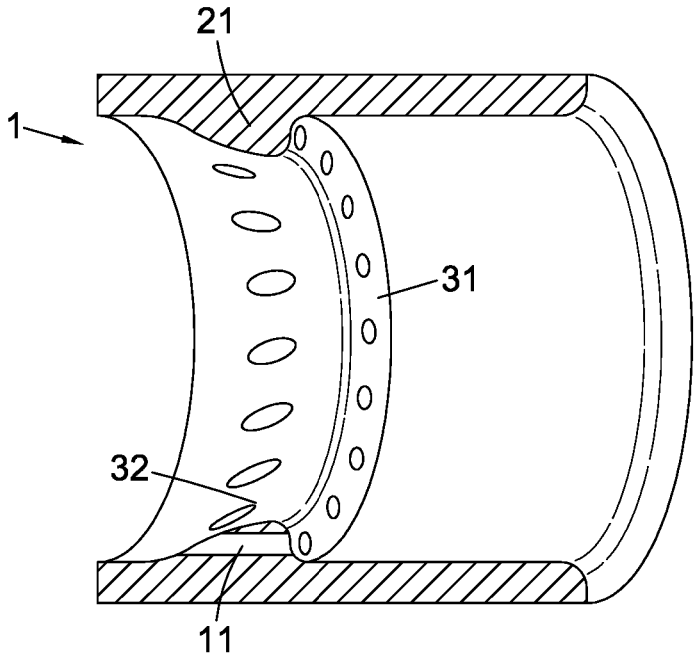
FIG. 2 is a schematic diagram showing the contours of the inner surface of the modified inlet duct.
Figure 3:
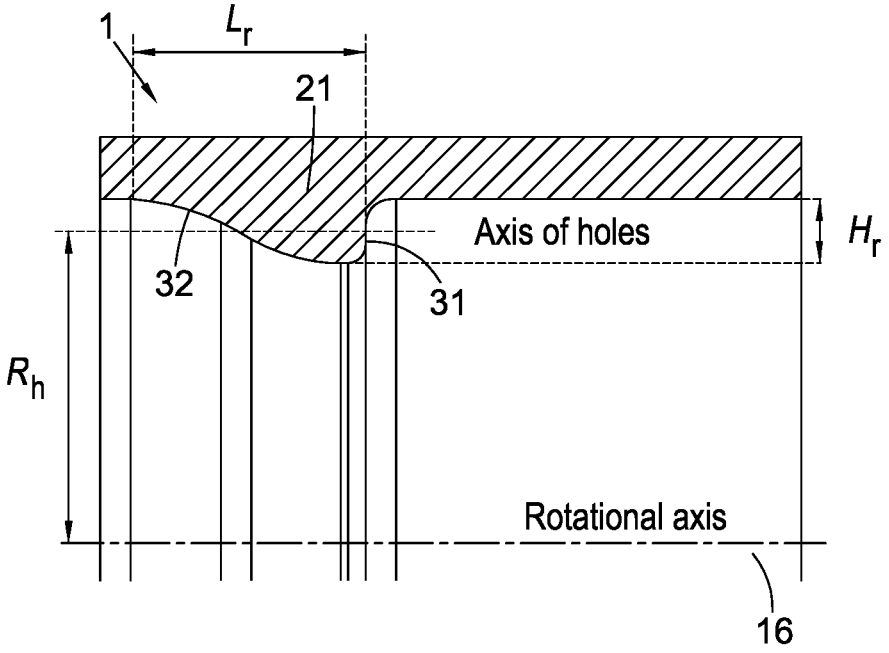
FIG. 3 is a schematic diagram of a meridional cross-section of the modified inlet duct.

The modified inlet duct 1 will now be described in more detail with continued reference to FIG. 1 as well as to FIG. 2, which is a schematic diagram showing the contours of the inner surface of the modified inlet duct 1, and FIG. 3, which is a schematic diagram of a meridional cross-section of the modified inlet duct 1. As can be seen in FIG. 1, the modified inlet duct 1 is a hollow cylinder, open at both ends. It is arranged in the compressor 10 so that its axis is the same as the axis of rotation 16 of the impeller 14. One of its ends is adjacent to the impeller 14, while the other end is open to receive ambient air. The modified inlet duct 1 has a circumferential rib 21 on its inner wall. This can be most clearly seen in FIGS. 2 and 3. The circumferential rib 21 is an area of the wall forming the modified inlet duct 1 which is thicker than the rest of the wall, such that it protrudes in a ring into the space through which air passes. In other words, the circumferential rib 21 forms a restriction in the modified inlet duct 1.

The shape of this circumferential rib 21 will now be further described with reference to FIG. 3. Envisaging the modified inlet duct 1 in cross-section and moving from right to left in FIG. 3—from the end of the modified inlet duct 1 which is coupled to receive ambient air to the end which is adjacent to the impeller blades 12—the circumferential rib 21 has a front end which is a radial wall 31 with a depth $H_r$. In this embodiment, $H_r$ is 10 mm. The radial wall 31 transitions to the inner wall of the modified inlet duct 1 with a radius. Behind the radial wall (that is, to the left in FIG. 3), the circumferential rib 21 slopes more gently to meet the inner wall of the modified inlet duct 1. The radial wall 31 transitions to the sloping section 32 with a gentle radius and the sloping section 32 transitions to the inner wall of the modified inlet duct 1 with a further gentle radius. The axial distance between the radial wall 31 and the point at which the sloping section 32 has transitioned to the inner wall of the modified inlet duct is $L_r$. In this embodiment, $L_r$ is 37.6 mm.

With reference now to FIG. 1, an array of holes 11 is formed in the circumferential rib 21. The holes 11 are each the same as one another in shape and orientation. A single hole 11 will now therefore be described, with reference to FIG. 3. The hole 11 is open at both ends. These ends are open to the interior of the modified inlet duct 1. One end of the hole is in the front end of the circumferential rib, that is, in the radial wall 31. The other end of the hole 11 is in the sloping section 32 of the circumferential rib 21. The axis of the hole is at a radial distance $R_h$ from the axis of rotation 16 of the impeller 14. $R_h$ is approximately equal to half of the depth of the circumferential rib 21 (i.e. half of the distance $H_r$) subtracted from the radius of the modified inlet duct 1. In this embodiment, $R_h$ is 50 mm With reference once again to FIG. 1, the hole 11 is circular in cross-section. The axis of the hole 11 is oblique to the rotational axis 16 of the impeller 14. The hole 11 lies in a plane tangential to and parallel to the axis of rotation 16 of the impeller 14, but at an angle in that plane to the rotational axis 16. The direction of inclination of the axis of the hole 11 depends on the direction of rotation of the impeller 14, as will become clear when the operation of the modified inlet duct 1 is described below. There are several holes 11 arranged at equal distances from one another around the circumferential rib 21, each in planes tangential to and parallel to the axis of rotation 16 of the impeller 14 and at the same angles in their respective planes to the rotational axis 16. In this embodiment, there are thirty holes 11. In other embodiments there may be different numbers of holes 11, as will later be discussed further with reference to FIG. 8.

[Operation]

Figure 4:
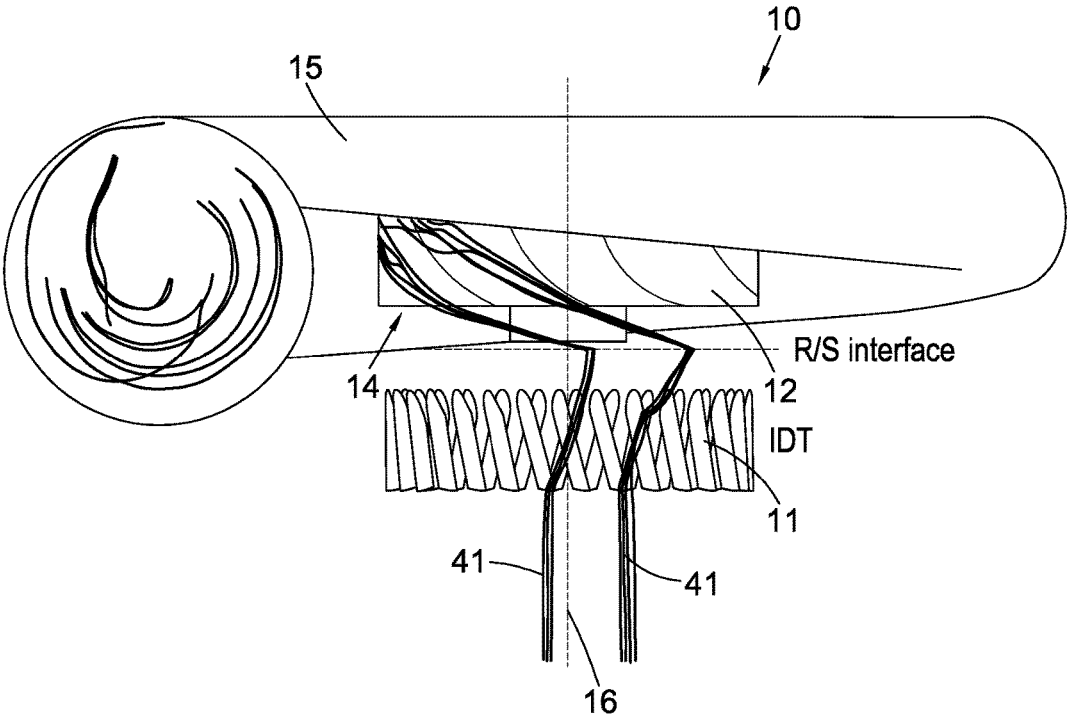
FIG. 4 shows streamlines through the modified inlet duct.

The operation of the centrifugal compressor 10 that includes the modified inlet duct 1 will now be described with reference to FIG. 4. FIG. 4 shows a side view of the compressor 10. The modified inlet duct 1 is not shown, but the holes 11 through its circumferential rib 12 are shown. In operation, the impeller 14 turns clockwise (when viewed along the axis and looking towards the impeller blades 12). As mentioned above, one end of the modified inlet duct 1 is coupled to draw air and the other end is adjacent to the impeller 14. The rotation of the impeller 14 therefore draws air through the modified inlet duct 1 and the rotating impeller 14 delivers this air into the volute 15.

To aid understanding, the following comments are made regarding the operation of a compressor without modifications to its inlet duct. In such a compressor, all of the air drawn through its inlet duct flows through the inlet duct in an axial direction and therefore meets the impeller blades 12 travelling in a direction parallel to the rotational axis 16 of the impeller 14. This will be discussed further with reference to FIG. 5(*a*). Instability leading to surge (discussed in the "Background" section of the description) tends to arise in the impeller 14. It has been discovered by the present inventors that it is the interaction between the tip clearance flow and transonic flow near the inlet duct at the impeller 14 inlet is the main factor for impeller 14 surge. Due to the large pressure gradient, the leakage vortex from the inlet duct clearance tends to be broken down by the shock wave on the suction surface of the impeller blades 12 near the inlet duct into a large amount of low momentum flow, which triggers the instability of the impeller 14. Casing treatment and the use of variable inlet guide vanes can help to suppress this interaction and increase compressor stability, but they have the disadvantages associated with them of, respectively: increasing the complexity and cost of a turbocharger and being ineffective at low speeds; and decreasing the mass flow at which choke onsets.

Returning now to the description of the operation of the modified inlet duct 1 with reference to FIG. 4, it has surprisingly been found that modifying the angle of air flow at just the tips of the impeller blades 12 can decrease the surge mass flow. This is because it has also been found that the precursor of the instability leading to surge arises at the tip of the impeller blades 12. FIG. 4 shows the streamlines 41 of the air passing through two of the holes 11 in the modified inlet duct 1. Streamlines of the air passing through the centre of the modified inlet duct 1 are not shown. The air passing through the centre of the modified inlet duct 1 travels approximately axially along the modified inlet duct 1 and therefore meets the impeller axis 16 and the area around it axially. This will be discussed in more detail below with reference to FIG. 5(*b*). Air flow closer to the walls of the modified inlet duct 1 is forced by the protruding circumferential rib 21 to pass through the holes 11 in the rib 21. As mentioned above with reference to FIG. 1, the axes of the holes 11 are oblique to the rotational axis 16 of the impeller 14. The holes 11 are angled towards the direction of rotation of the impeller 14. Air passing through the holes 11 is therefore swirled towards the rotational direction of the impeller 14. This swirled flow near the exit to the modified inlet duct 1 influences the incidence angle at the impeller blade 12 tips and thus the flow field through the impeller 14. The swirled angle is mainly determined by the angle of inclination of the holes 11. The smooth shape of the curve of the circumferential rib 21 over the distance $L_r$ acts as a fairing to prevent any flow which did not pass through the holes 11 from detaching as a result of passing over the circumferential rib 21.

Figure 5:
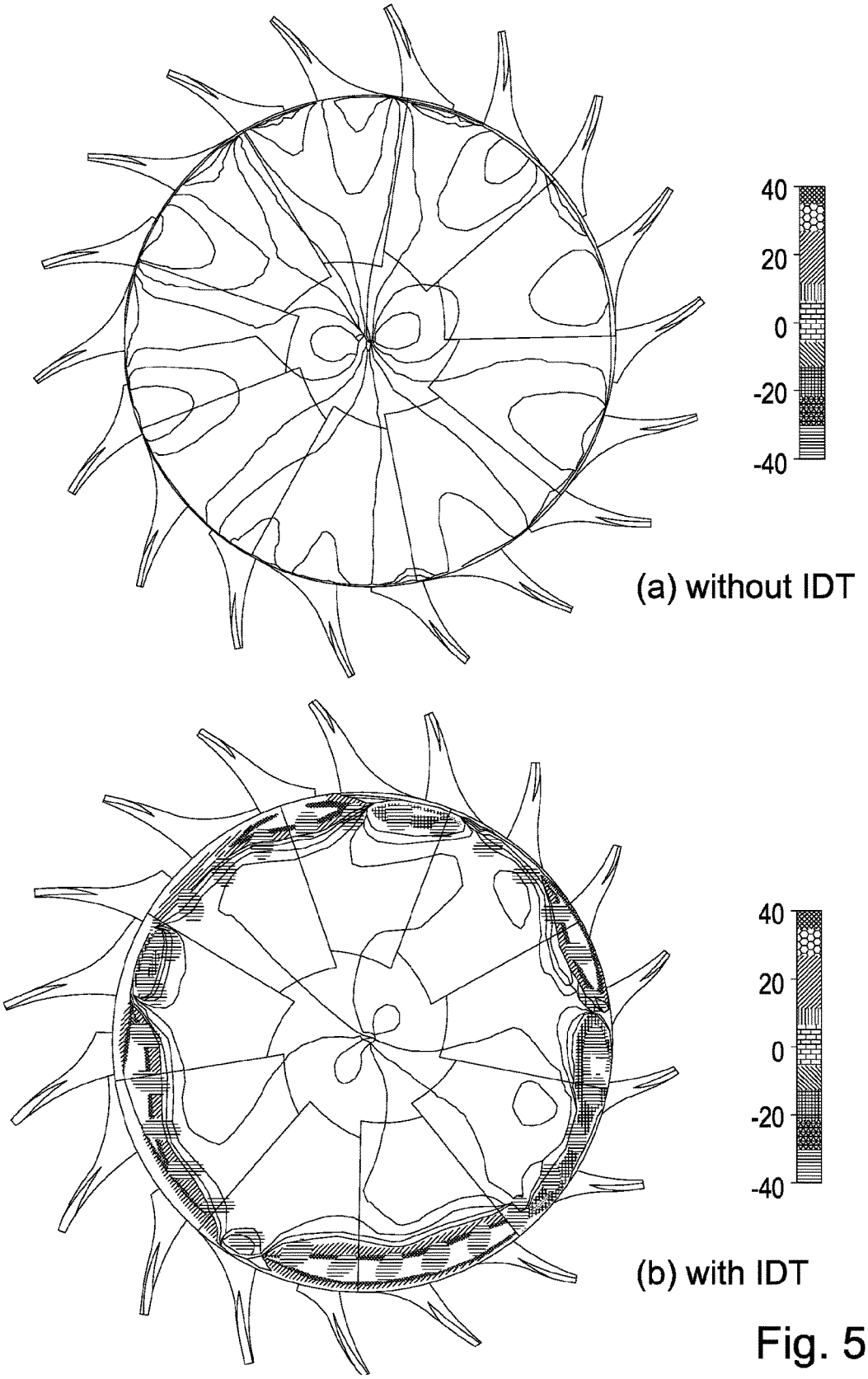
FIG. 5(*a*) shows the distribution of absolute flow angle near the inlet of the impeller in a compressor without a modified inlet duct.

FIG. 5(*a*) shows the distribution of absolute flow angle near the inlet of the impeller 14 in a compressor without a modified inlet duct, near surge condition and at 100% design speed (N). The angle of air flow to the impeller blades 14 is about 0 degree and is relatively uniform along the blade 14.

FIG. 5(*b*) shows the distribution of absolute flow angle near the inlet of the impeller 14 in the compressor 10 including the modified inlet duct 1, again near surge condition and at 100% N. Around the impeller axis 16, the flow is similar to the flow in the compressor without the modified inlet duct: it is mainly in the axial direction. The holes 11 and the circumferential rib 21 in the modified inlet duct 1 cause the flow angle to increase near the blade tips, producing a positive swirled effect. This swirled effect improves the stability of the impeller 14 by reducing the incidence angle of the flow onto the impeller blade 12 tips.

By contrast, the use of inlet guide vanes as discussed in the background section swirls all the air flow from the impeller axis 16 to the blade 12 tips. This swirl effect throttles the inlet flow since it reduces the axial component of the air flow velocity. This reduces the choke mass flow rate of a compressor using inlet guide vanes. By focusing the pre-swirl of the air flow on the area around the compressor blade 12 tips, as in the present compressor, this throttle effect is greatly reduced.

Figure 6:
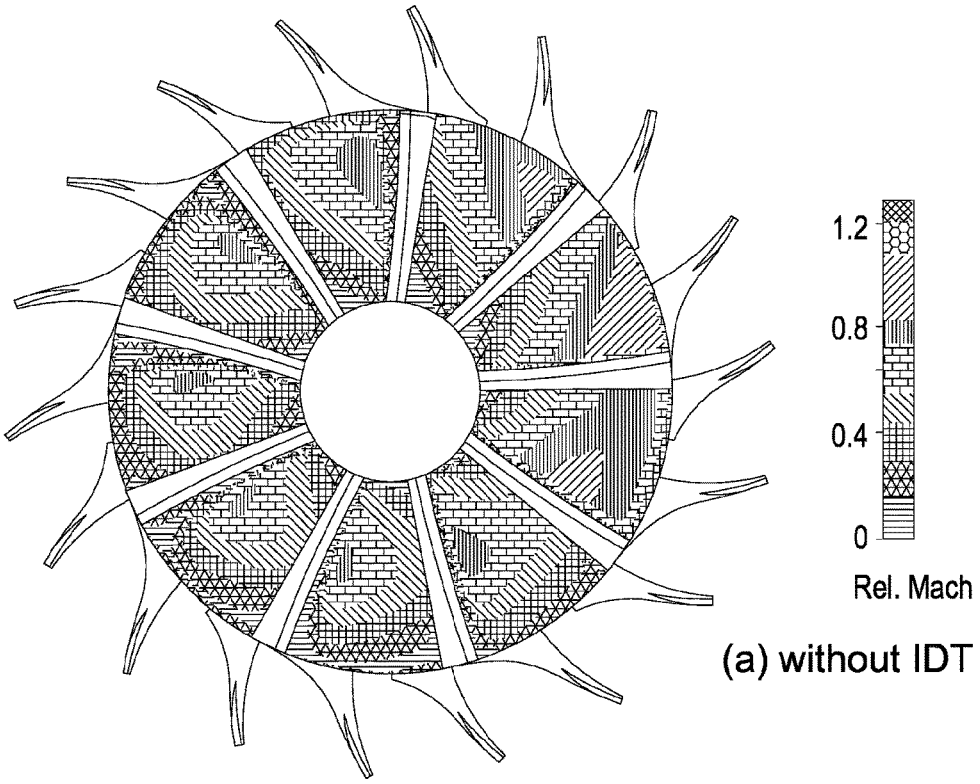
FIG. 6(*a*) shows the relative Mach number distribution in a surface behind the impeller leading edges in a compressor without a modified inlet duct.
Figure 6:
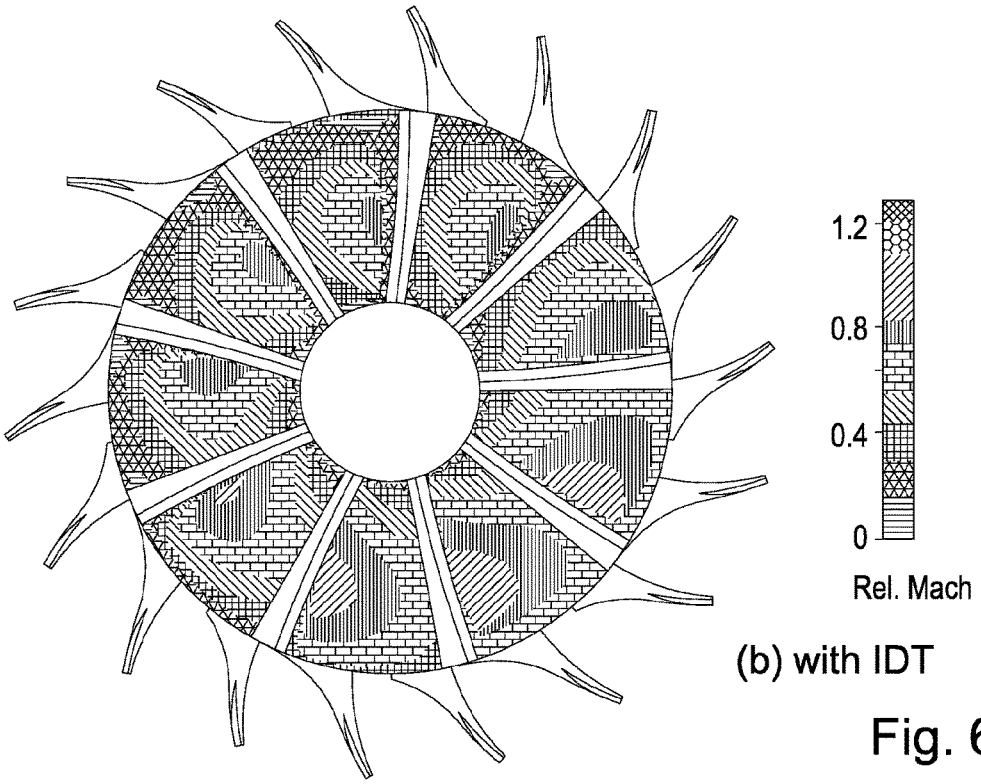

FIG. 6(*a*) shows the relative Mach number distribution in a surface behind the impeller 14 leading edges in a compressor without a modified inlet duct 1 near surge conditions. FIG. 6(*b*) shows the relative Mach number distribution in the same surface behind the impeller leading edges and again under surge conditions, but this time in the compressor 10 including the modified inlet duct 1. In both compressors, there is low momentum flow in the area of the impellers radially nearest the inlet duct. In the compressor 10 including the modified inlet duct 1, however, the amount of low momentum flow near surge conditions is reduced. In other words, the maximum mass flow rate at which surge occurs is reduced in the compressor 10 including the modified inlet duct 1. The low momentum flow near the impeller axis 16 can also be seen to reduce as a result of the modified inlet duct 1. The flow near the walls of the inlet duct treatment 1 is forced to move towards the axis 16 by the circumferential rib 21. This reduces the incidence angle of the air flow near the axis 16, increasing the axial flow rate near the axis 16 near the surge condition.

Figure 7:
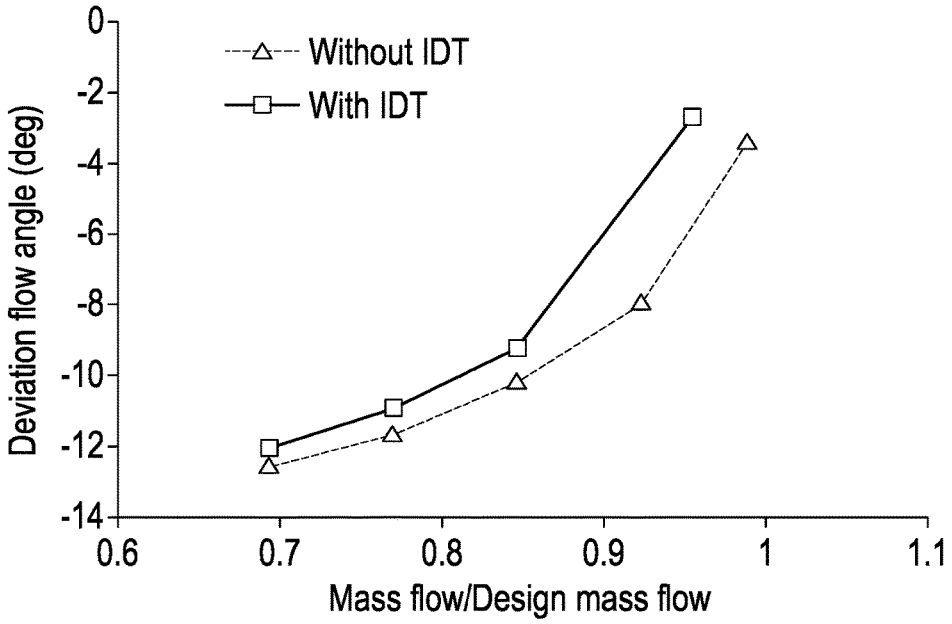
FIG. 7 is a graph of the deviation angle (the difference between the angle of flow direction and blade angle) at the impeller inlet for the compressor including the modified inlet duct and for a compressor without a modified inlet duct.

The increased axial flow near the impeller axis 16 and the pre-swirling of the flow near the impeller blade 12 tips influences the flow development through the impeller 14 passages. FIG. 7 is a graph of the difference between the angle of flow direction and the impeller blade 12 angle at the impeller 14 inlet for the compressor 10 including the modified inlet duct 1 (points plotted with squares) and for a compressor without a modified inlet duct (points plotted with triangles), both at 100% N. This deviation angle reflects the flow conditions in the impeller: a larger value indicates greater secondary flow in the impeller 14 passages (that is, the spaces between the impeller blades 12). Secondary flow in these passages is reduced by the modified inlet duct 1, as can be seen from the reduction in deviation angle for the compressor 10 with the modified inlet duct 1.

Figure 8:
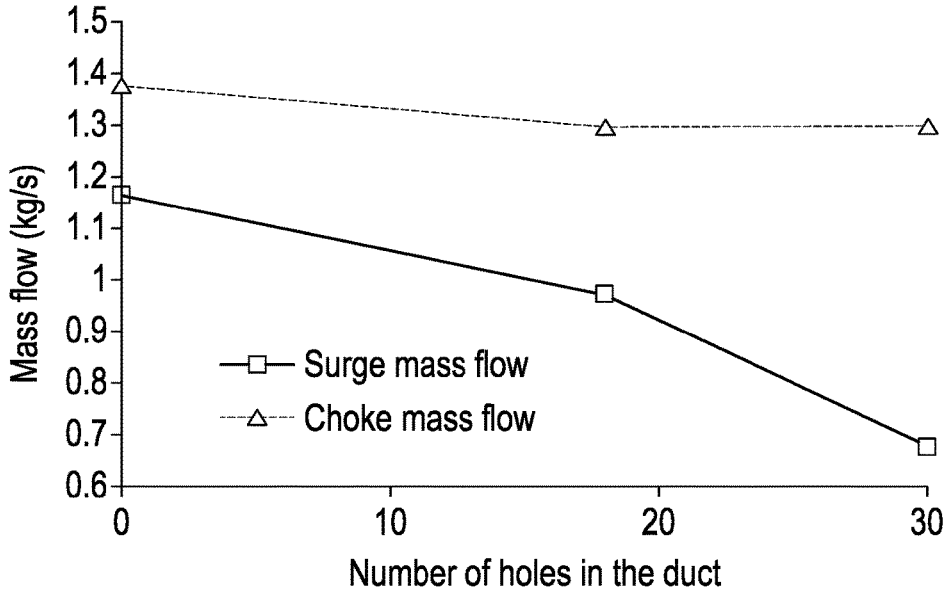
FIG. 8 is a graph showing the influence of the number of holes in the modified inlet duct on the surge and choke mass flow rates of the compressor.

FIG. 8 is a graph showing the influence of the number of holes 11 in the modified inlet duct 1 on the surge and choke mass flow rates of the compressor 10. The surge and choke mass flows for a compressor without a modified inlet duct 1 are represented on this graph by the points at zero hole number. The introduction of a modified inlet duct 1 reduces the surge mass flow rate. As the number of holes in the modified inlet duct 1 is increased to 30, the surge mass flow reduces even further. Although choke mass flow rate is reduced slightly by the introduction of the modified inlet duct 1, the reduction in surge mass flow more than compensates for this slight reduction, increasing the stable operating mass flow range of the compressor 10. This is in contrast with the use of variable inlet guide vanes in a compressor, which, as discussed in the "Background" section, significantly reduce the choke mass flow rate of the compressor in which they are used, merely shifting the stable operating mass flow range of the compressor. It is noted that the choke mass flow rate is relatively stable as number of holes increases, indicating that the choke flow rate is mainly determined by the shape of the circumferential rib 21.

In an alternative embodiment, rather than holes 11, the circumferential rib of the modified inlet duct has open channels formed in its surface. Similarly to the holes, these channels are in a plane tangential to and parallel to the axis of rotation 16 of the impeller 14, but at an angle to the rotational axis 16 in that plane. As with the embodiment described hereinabove, the circumferential rib of this alternative embodiment has a flat front face 31 which in operation encourages air flowing through the modified inlet duct to flow through these channels. Air exiting these channels at the impeller 14 inlet flows in the direction of rotation of the impeller blades 12. This alternative embodiment therefore provides a similar swirled flow in the region of the impeller blade 12 tips as does the first embodiment, while leaving axial flow in the region of the impeller axis 16 mostly undisturbed.

In a further alternative embodiment, swirled flow in the region of the impeller blade 12 tips and mostly undisturbed axial flow in the region of the impeller axis 16 is achieved by injecting additional fluid at the impeller 14 inlet. This additional fluid is injected at an angle, so that a component of its velocity is in the direction of rotation of the impeller blades 12. In this alternative embodiment, the additional fluid is air from the outlet of the compressor 10. In other alternative embodiments, the additional fluid could be, for example, fluid from the inner part of the compressor. It could alternatively be engine exhaust gas from the turbine side of the turbocharger of which the compressor forms part.

The invention claimed is:

1. A centrifugal compressor comprising:

an inlet; and an impeller comprising a hub and blades;

the inlet for conveying flow to the impeller comprising guide means arranged to guide the flow through the inlet to induce swirl in the flow adjacent tips of the blades, the direction of swirl being the direction of rotation of the blades, without substantially disturbing flow adjacent the hub;

wherein the flow is incident on the guide means and the guide means is arranged to guide the flow by providing at least one surface that is substantially oblique to the flow incident on the guide means, wherein each of the at least one surfaces is embodied by a passageway, wherein each passageway is a hole.

2. The centrifugal compressor of claim 1, wherein the guide means comprises structure that deflects the flow.

3. The centrifugal compressor of claim 1, wherein the at least one surface is substantially oblique to the axis of the inlet.

4. The centrifugal compressor of claim 1, wherein each passageway is formed in the structure of the inlet.

5. The centrifugal compressor of claim 1, wherein each passageway is substantially in a plane tangential to the structure of the inlet and parallel to the axis of the inlet.

6. The centrifugal compressor of claim 5, wherein each passageway is substantially at the same angle in its respective plane to the axis of the inlet as each other passageway.

7. The centrifugal compressor of claim 1, wherein the inlet comprises a restriction of smaller inner diameter than the inner diameter of the remainder of the inlet.

8. The centrifugal compressor of claim 7, wherein the restriction comprises a face substantially perpendicular to the axis of the inlet.

9. The centrifugal compressor of claim 8, wherein the restriction is shaped to comprise a surface which slopes from the perpendicular face to the wall of the inlet.

10. The centrifugal compressor of claim 7, wherein each passageway is located in the restriction.

11. The centrifugal compressor of claim 10, wherein the passageways are holes and pass through the restriction.

12. The centrifugal compressor of claim 10, wherein there is a plurality of passageways, each angularly distributed in the restriction around, and with respect to, the axis.

13. A turbocharger comprising a centrifugal compressor according to claim 1.

14. An inlet for conveying flow to an impeller of a centrifugal compressor, the inlet comprising guide means arranged to guide the flow through the inlet to induce swirl in the flow adjacent tips of blades of the impeller, the direction of swirl being the direction of rotation of the blades, without substantially disturbing the flow adjacent the hub of the impeller;

wherein the flow is incident on the guide means and the guide means is arranged to guide the flow by providing at least one surface that is substantially oblique to the flow incident on the guide means, wherein each of the at least one surfaces is embodied by a passageway, wherein each passageway is a hole.

15. Guide means for fitting to an inlet of a centrifugal compressor, the guide means arranged to guide the flow through the inlet to induce swirl in the flow adjacent tips of blades of an impeller of the centrifugal compressor, the direction of swirl being the direction of rotation of the blades, without substantially disturbing the flow adjacent the hub of the impeller;

wherein the flow is incident on the guide means and the guide means is arranged to guide the flow by providing at least one surface that is substantially oblique to the flow incident on the guide means, wherein each of the at least one surfaces is embodied by a passageway, wherein each passageway is a hole.

* * * * *